US008333206B2

(12) United States Patent
Goddard

(10) Patent No.: US 8,333,206 B2
(45) Date of Patent: Dec. 18, 2012

(54) PARTS WASHER

(75) Inventor: Fenton Goddard, Como (AU)

(73) Assignee: Wasabi (Holdings) Pty Ltd, Como (AU)

( * ) Notice: Subject to any disclaimer, the term of this patent is extended or adjusted under 35 U.S.C. 154(b) by 726 days.

(21) Appl. No.: 11/992,444

(22) PCT Filed: Sep. 21, 2006

(86) PCT No.: PCT/AU2006/001385

§ 371 (c)(1),
(2), (4) Date: Jul. 22, 2009

(87) PCT Pub. No.: WO2007/033422

PCT Pub. Date: Mar. 29, 2007

(65) Prior Publication Data

US 2009/0301528 A1 Dec. 10, 2009

(30) Foreign Application Priority Data

Sep. 21, 2005 (AU) ..... 2005905202

(51) Int. Cl.
*B08B 3/02* (2006.01)

(52) U.S. Cl. ..... 134/153; 134/157; 134/180; 134/182; 239/263.1; 239/263.3

(58) Field of Classification Search ..... 133/153, 133/157, 180, 182; 239/263.1, 263.3, 264; 134/153, 157, 180, 182
See application file for complete search history.

(56) References Cited

U.S. PATENT DOCUMENTS

| | | | | | |
|---|---|---|---|---|---|
| 1,941,915 | A | * | 1/1934 | Rosenberger | 134/112 |
| 2,426,291 | A | * | 8/1947 | Abrams | 134/138 |
| 2,918,925 | A | * | 12/1959 | Dopler | 134/108 |
| 3,324,867 | A | * | 6/1967 | Freese | 134/99.1 |
| 3,416,545 | A | * | 12/1968 | Holzemer | 134/129 |
| 3,439,689 | A | * | 4/1969 | Zadron et al. | 134/104.4 |
| 4,143,669 | A | | 3/1979 | Minkin | |
| 4,699,162 | A | * | 10/1987 | Huddle et al. | 134/141 |
| 4,741,351 | A | * | 5/1988 | Minkin | 134/144 |
| 4,744,379 | A | | 5/1988 | Goettel | |
| 5,029,595 | A | | 7/1991 | Hautau | |

(Continued)

FOREIGN PATENT DOCUMENTS

DE 3248555 7/1984

(Continued)

OTHER PUBLICATIONS

International Search Report for PCT/AU2006/001385, filed Sep. 21, 2006 (mailed Nov. 16, 2006).

(Continued)

*Primary Examiner* — Frankie L Stinson
(74) *Attorney, Agent, or Firm* — Klarquist Sparkman, LLP

(57) ABSTRACT

A parts washer comprises a cabinet, a platform, a liquid distributor, a coupling, and a drive system. The platform is disposed inside the cabinet and supports articles that are required to be cleaned. The distributor is disposed inside the cabinet to one side of the platform and has one or more outlets that direct the liquid in a generally radial direction toward the platform. The coupling couples the distributor to an inside of the cabinet in a manner allowing at least 2°of freedom of motion of the distributor. More particularly, the coupling allows the distributor to move in a complex motion comprising a combination of tilting, rotation and up and down motion.

13 Claims, 8 Drawing Sheets

U.S. PATENT DOCUMENTS

| | | | | |
|---|---|---|---|---|
| 5,106,428 | A * | 4/1992 | Goerss et al. | 134/38 |
| 5,398,708 | A | 3/1995 | Sheldon | |
| 5,482,064 | A * | 1/1996 | Goddard | 134/57 R |
| 5,482,066 | A | 1/1996 | Krueger | |
| 5,913,354 | A | 6/1999 | Conroy et al. | |
| 5,932,026 | A * | 8/1999 | Trampusch | 134/7 |
| 6,044,852 | A | 4/2000 | Epperson et al. | |
| 6,390,106 | B1 * | 5/2002 | Lin | 134/172 |
| 6,550,489 | B1 * | 4/2003 | Yates | 134/140 |
| 7,128,075 | B2 * | 10/2006 | Publ | 134/107 |
| 2005/0115593 | A1 | 6/2005 | Publ | |

FOREIGN PATENT DOCUMENTS

| | | |
|---|---|---|
| JP | 2004-275819 | 10/2004 |
| WO | 2004/091817 | 10/2004 |

OTHER PUBLICATIONS

Supplemental European Search Report for EP06790264 (completed Aug. 11, 2009).

* cited by examiner

PARTS WASHER

CROSS REFERENCE TO RELATED APPLICATIONS

This is the U.S. National Stage of International Application No. PCT/AU2006/001385, filed Sep. 21, 2006, which was published in English under PCT Article 21(2), which in turn claims the benefit of Australian Patent Application No. 2005905202, filed Sep. 21, 2005. Both applications are incorporated herein by reference in their entirety.

FIELD

This application relates to a parts washer particularly, though not exclusively, for washing mechanical parts and components such as may be found in an automotive repair workshop.

BACKGROUND

The present inventor is also the inventor of a parts washer described in International Publication Number WO 2004/091817. The aforementioned publication describes a parts washer having a cleaning chamber and a receptacle into which parts to be cleaned are placed. The receptacle is rotatably mounted on its central axis within the cleaning chamber and is rotated by a drive motor. One or more manifolds are provided, each having a plurality of water jets arranged to deliver cleaning fluid onto the parts in the receptacle. The manifolds are movably mounted within the cleaning chamber and are coupled to the drive motor to cause a reciprocating motion of the manifolds. One of the manifolds includes a vertical manifold that is disposed adjacent to the receptacle. This manifold travels with a combined up and down motion, as well as rotating about a functional axis. A relatively complex linkage arrangement is provided in order to produce the motion of the vertical manifold.

The present application describes approaches to providing a parts washer of alternate construction and associated methods.

In the claims of this application and in the description of the invention, except where the context requires otherwise due to express language or necessary implication, the words "comprise" or variations such as "comprises" or "comprising" are used in an inclusive sense, i.e., to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

SUMMARY

Described herein is a parts washer comprising:

a cabinet;

a rotatable platform disposed in the cabinet on which articles to be cleaned are supported;

a liquid distributor located inside the cabinet and to a side of the platform, the liquid distributor having one or more outlets that direct liquid in a generally radial inward direction with respect to an axis of rotation of the platform;

a coupling that couples the distributor to the cabinet in the manner allowing at least two degrees of freedom of motion of the distributor; and, a drive system that drives the distributor to move with the at least two degrees of freedom.

In one embodiment the coupling allows the distributor to move with any one, or a combination of any two or more, of the following motions:

(a) a reciprocating tilting motion generally radially toward and away from the platform;

(b) a reciprocating rotational motion about a longitudinal axis of the distributor; and, (c) a reciprocating up and down motion.

In one embodiment the coupling comprises a pin coupled to the distributor and a slot along which the pin can slide. Additionally the pin and slot are relatively configured to allow the pin to rotate about a longitudinal axis of the pin. Further the pin and slot are relatively configured to allow the pin to move in the slot in a direction parallel to the longitudinal axis.

In another embodiment the coupling may comprise first and second ball joints acting between the cabinet and the distributor. The ball joints may also be coupled together by a first swivel joint.

In one embodiment the distributor comprises part of a manifold system that directs liquid toward the platform, the manifold system comprising a pipe that is coupled by a swivel joint to an end of the distributor opposite the coupling.

The distributor typically extends in a generally upright disposition.

In this or an alternate embodiment the parts washer may further comprise a support system that supports the platform about its radial outer periphery. In one embodiment the support system comprises a plurality of lands that extend inward from an internal surface of the cabinet. In addition, or as an alternative, the support system may further comprise one or more rollers or bearings that support the radial outer periphery of the platform. The rollers or bearings may take the form of a bobbin roller or bearing having a circumferential groove in which the platform is supported.

In one embodiment, the drive system engages a radial outer periphery of the platform to impart torque to the platform.

The cabinet may comprise: a receptacle in which the platform is disposed; and, a lid hinged to the receptacle, where the receptacle is made of a plastics or composite material. One suitable material is double wall, foam filled, high density polyethylene. The lid may also be made of the same material as the receptacle.

According to a further aspect of the invention there is provided a method of cleaning an article comprising:

cyclically moving an article through a cleaning zone;

directing a first group of one or more jets of liquid toward the cleaning zone from a first location to a side of the cleaning zone; and, cyclically sweeping the first group of jets across the cleaning zone from the first location wherein the sweeping of the first group of jets comprises a reciprocating tilting motion of the jets toward and away from the cleaning zone.

The method may further comprise sweeping the first group of jets with a reciprocating rotational motion about a longitudinal axis along which the first group of jets are arranged. The sweeping of the first group of jets may further comprise reciprocating the jets in an up and down motion.

The method of cleaning may also comprise directing a second group of one or more jets of a liquid toward the cleaning zone from a second location above the cleaning zone and cyclically sweeping the second group of jets across the cleaning zone from the second location. In addition the method may comprise directing a third group of one or more jets of a liquid toward the cleaning zone from a location below the cleaning zone and cyclically sweeping the third group of jets across a cleaning zone from the third location.

BRIEF DESCRIPTION OF THE DRAWINGS

The embodiments of the present invention will now be described by example only with reference to accompanying drawings.

DETAILED DESCRIPTION OF PREFERRED EMBODIMENTS

Figure 1:
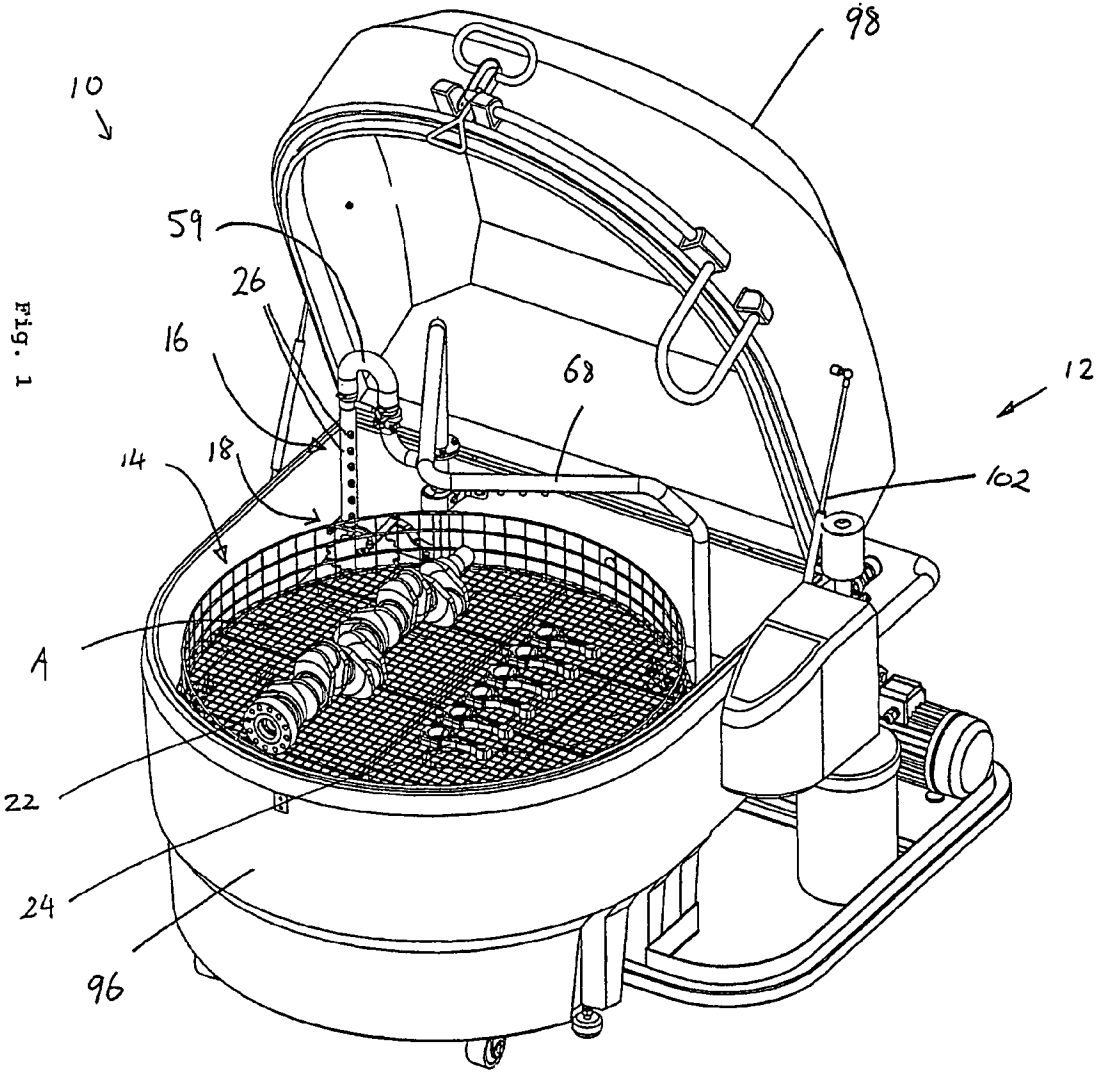
FIG. 1 is a perspective view of a parts washer in accordance with an embodiment of the present invention.

With reference to the accompanying drawings and in particular FIGS. 1-4*b* a parts washer 10 in accordance with an embodiment of the present invention comprises a cabinet 12, a platform 14, a liquid distributor 16, a coupling 18, and a drive system 20. The platform 14 is disposed inside the cabinet 12 and supports articles, such as a crank shaft 22 and conrods 24, that are required to be cleaned. The distributor 16 is disposed inside the cabinet 12 to one side of the platform 14 and has a group of one or more outlets 26 that direct liquid in a generally radial direction toward the platform 14. In one embodiment the outlets 26 provide a corresponding group of solid jets of liquid having minimal radial spread, rather than a fanned spray of liquid, although in an alternate embodiment a fanned spray may be used. The solid jet itself provides a mechanical cleaning effect by physically "blasting" contaminants, grime and oil from the articles to be cleaned. The coupling 18 couples the distributor 16 to an inside of the cabinet 12 in the manner allowing at least two degrees of freedom of motion of the distributor 16. The drive system 20 drives the distributor 16 so as to move with the at least two degrees of freedom. More particularly in the illustrated embodiments, and will be explained in greater detail below, the coupling 18 allows the distributor 16 to move in a complex motion comprising in combination tilting, rotational, and up and down motion.

The platform 14 has a radial outer periphery comprising an outer peripheral band 28 in the shape of a circle and inside of which extends a mesh 30. The mesh 30 is typically attached by way of welding to the band 28. Beneath the mesh extends two groups of support bars 32*a,* and 32*b*. The support bars 32*a* extend parallel to each other as do the support bars 32*b* however the support bars 32*a* are perpendicular to the support bars 32*b*. A gear mechanism 34 is provided about a radial outer periphery edge of the platform 14. In this particular embodiment the gear mechanism 34 is in the form of a chain 35 of a structure similar to a bicycle chain attached to an outer circumferential surface of the band 28.

Figure 3:
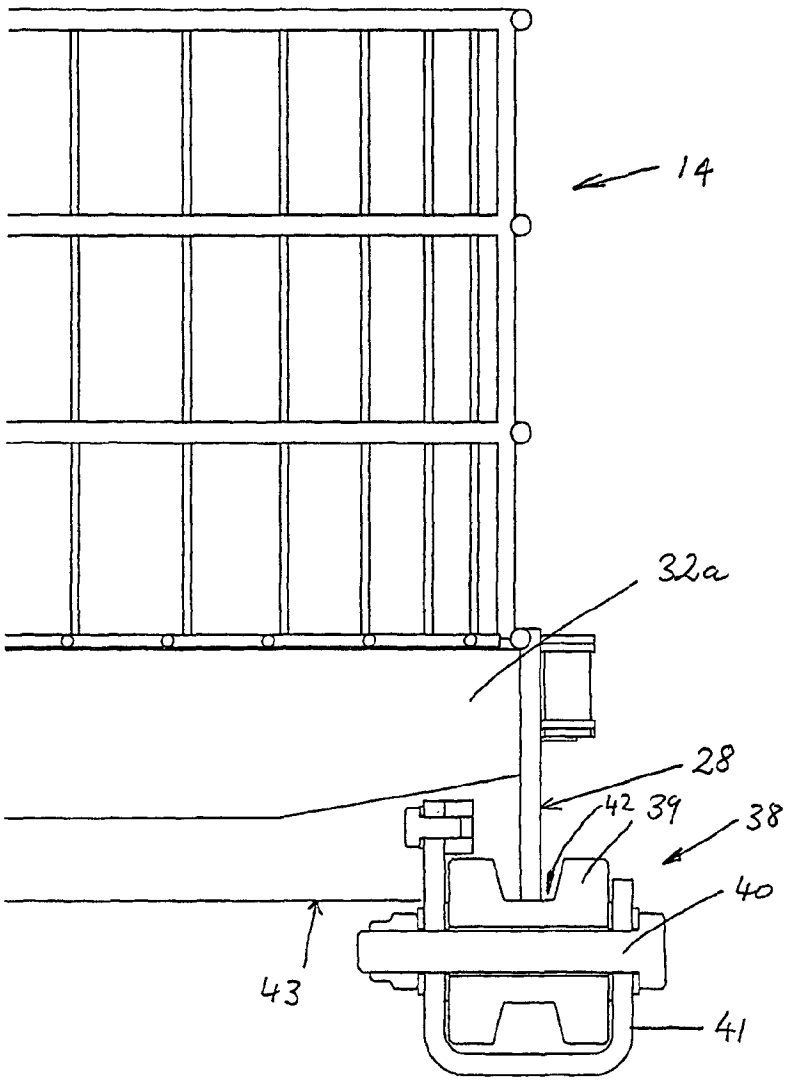
FIG. 3 is a schematic representation of a support system for the platform in the parts washer.

As shown most clearly in FIG. 3, the parts washer 10 further comprises a support system 36 that supports the platform 14 about its radial outer periphery. The support system 36 comprises five evenly spaced bobbin roller or bearing assemblies 38. Each bobbin roller assembly 38 comprises a bobbin roller or bearing 39 rotatably held by a pin 40 coupled to a corresponding bracket 41. A circumferential channel 42 is provided inboard of the ends of the bobbin roller 39. Each bracket is fixed to the inside of the cabinet 12. Each bobbin roller or bearing pair 39 supports an under surface 43 of the band 28 in its corresponding channel 42.

Figure 2B:
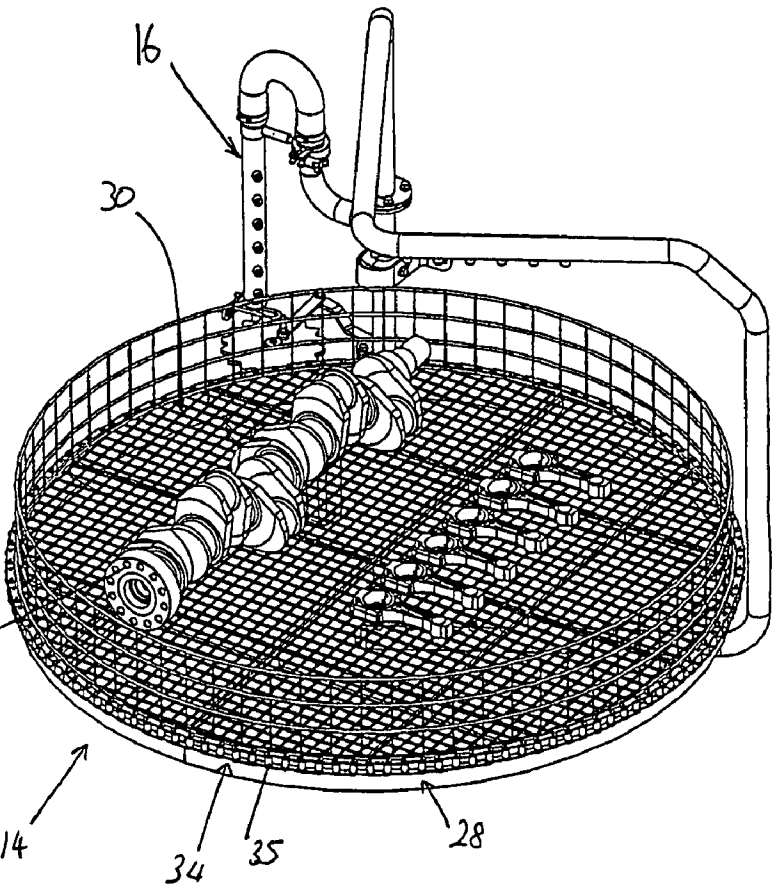
FIG. 2*b* depicts the apparatus shown in 2*a* viewed from an opposite direction.
Figure 2A:
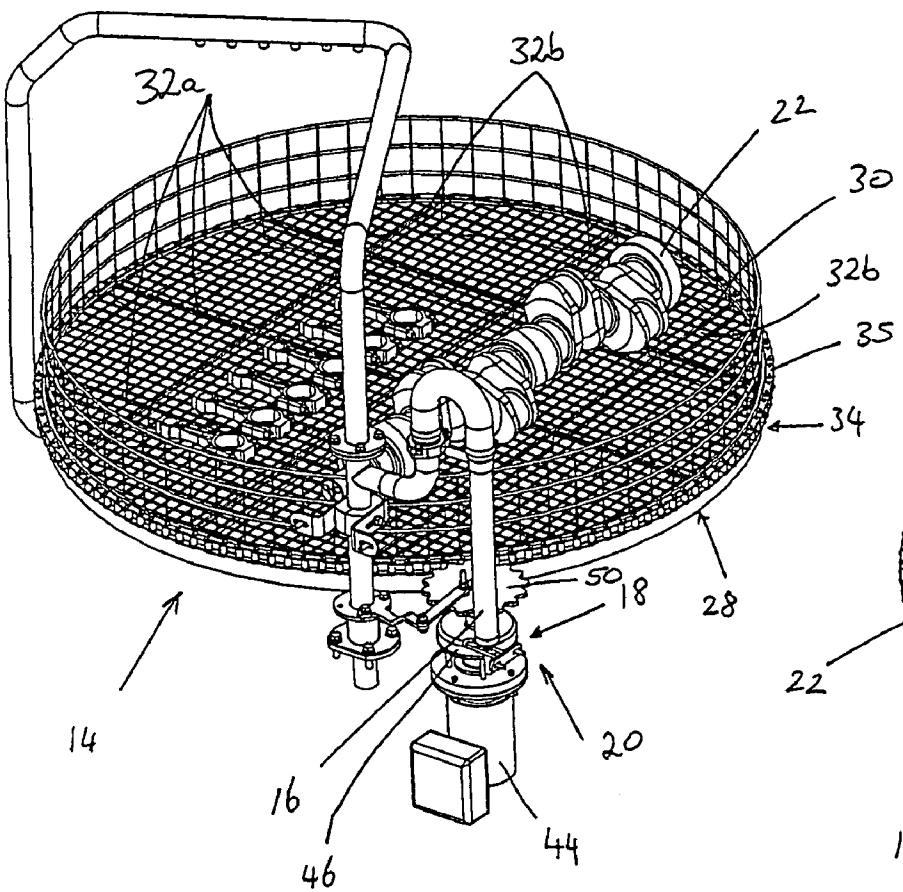
FIG. 2*a* is a schematic representation of a platform, manifold system and a drive system incorporated in the parts washer.
Figure 4B:
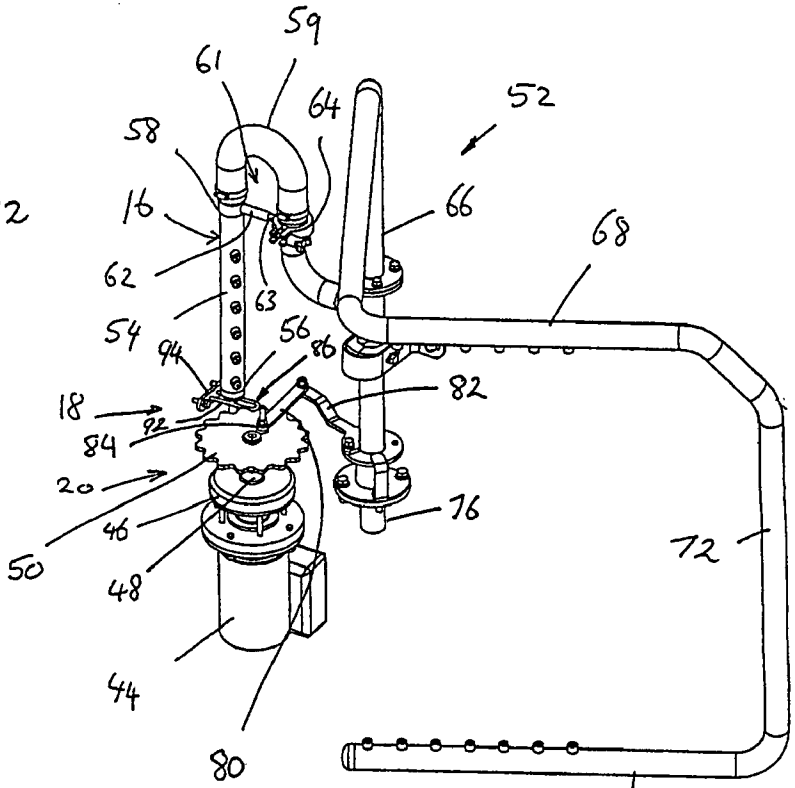
FIG. 4*b* is an alternate view of the manifold system and drive system shown in FIG. 4*b;*
Figure 4A:
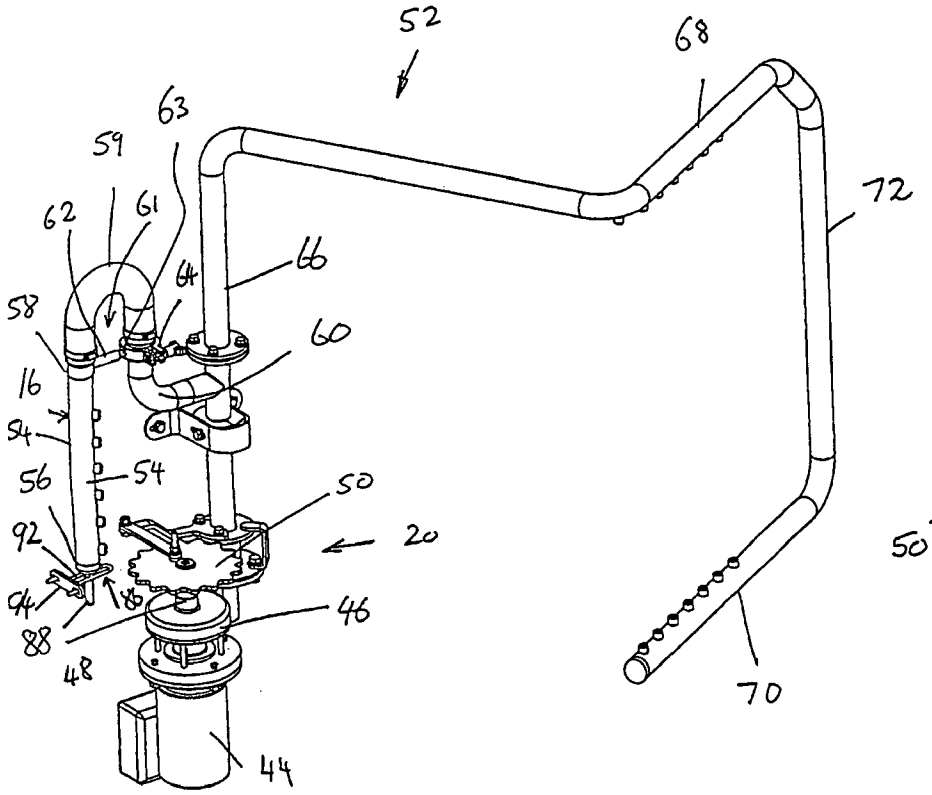
FIG. 4*a* is a schematic representation of the manifold system and drive incorporated in the parts washer.

Referring to FIGS. 2*a*, 4*a* and 4*b* the drive system 20 comprises an electric motor 44 imparting torque to a gear box 46 which in turn drives a shaft 48 and an attached gear wheel 50. The gear wheel 50 meshes with the gear mechanism 34/chain 35 so that when power is provided to the electric motor 44 torque is imparted from the motor 44 via the gear box 46, shaft 48 and gear 50 to the platform 14 causing it to rotate about its axis.

Referring to FIGS. 4*a* and 4*b*, the distributor 16 comprises part of a manifold system 52 that directs liquid onto the parts 22 and 24 from above, below, and the side of the platform 14. More particularly, the distributor 16 is in the form of a manifold or tube 54 and extends in a generally upright disposition to the side of the platform 14. A lower end 56 of the tube 54 is attached to the coupling 18. An upper end 58 is coupled by a flexible hose 59 bent in an inverted "U" shape configuration to a rigid elbow 60. The end 58 of tube 54 is attached to the elbow 60 by a swivel joint 61. The swivel joint 61 comprises an elongated socket or pipe 62 and a pin 63 that sits in the pip 62 and can rotate about its longitudinal axis. The socket or pipe 62 is fixed at one end to the tube 54 with the pin 63 fixed to a bracket 64 clamped about the elbow 60.

The manifold system 52 further comprises a main intake pipe 66 that is in fluid communication with the distributor 16 (i.e., tube 54) via the elbow 60, as well as upper and lower horizontal manifolds 68 and 70 respectively. Fluid communication between the upper and lower horizontal manifold 68, 70 is via a coupling manifold 72. Each of the horizontal manifolds 68, 70 comprises a length of pipe and is provided with a plurality of outlets 74. Each outlet 74 on the manifold 68 deliver or direct liquid as solid jets from above the platform 14 while the outlets 74 of the lower horizontal manifold 70 deliver liquid, also as solid jets, from beneath the platform 14. A lower end 76 of the intake pipe 66 is seated in a swivel joint that in turn provides fluid communication to a pump (not shown) which pumps liquid into the intake pipe 66.

Referring to FIG. 4*b* the gear wheel 50 is attached by a link 80 to a lever arm 82 that is attached to and extends perpendicular from the intake pipe 66. The link 80 is attached at a point 84 to the gear wheel that is radially offset from an axis of rotation from the gear wheel 50. Therefore, rotation of the gear wheel 50 provides a reciprocating motion to the intake pipe 66 causing it to rotate back and forth about its longitudinal axis.

As most clearly seen in FIGS. 4*a* and 4*b*, the coupling 18 comprises a pin 86 and a slot 88 in which the pin 86 resides. The pin 86 extends co-axially of the distributor 16/pipe 54 from an end cap 90 coupled to the lower end 56 of pipe 54, and has a circular cross section. The slot 88 is created as the space between parallel legs of a U shaped rod 92, the opening of which is closed by a flange or plate 94 that is attached to the inside of the cabinet 12. The pin 86 can: slide longitudinally along the slot 88; rotate about its axis within the slot; and move linearly in the direction of its axis. Although not shown a cross bar or stop plate can be attached to the free end of the pin 86 to prevent it from being fully withdrawn from the slot 88. However this is not believed critical as the overall weight and structure of the distributor 16 and manifold system 52 will maintain the pin 86 in the slot 88 during normal operation of the parts washer 10.

Figure 5A:
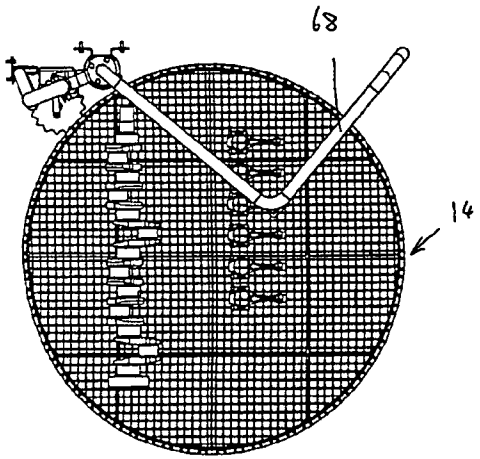
FIGS. 5*a* and 5*b* depict plan and side views respectively of the manifold system including a distributor of the manifold system in a first position.

When power is supplied to the motor 44 causing the gear 50 to rotate about its central axis, the link 80 and lever arm 82 act to cause the intake pipe 66 to reciprocate about its longitudinal axis. This in turn causes the upper and lower horizontal manifolds 68, 70 to move with a reciprocating motion in a horizontal plane sweeping across a sector of the platform 14 from an outer position toward the axis of rotation of the platform, as depicted sequentially in FIGS. 5*a*, 6*a* and 7*a* and back. Since the platform 14 is simultaneously being rotated about its central axis this motion ensures that substantially all of the upper and lower surfaces of the components 22 and 24 are impacted by liquid directed from the manifolds 68 and 70. It would be further appreciated that as the platform 14 is supported about its periphery rather than via a central axial hub, an article can be placed in the centre of the platform 14 and impacted from above and below (as well as from the side) with jets of liquid.

Figure 5B:
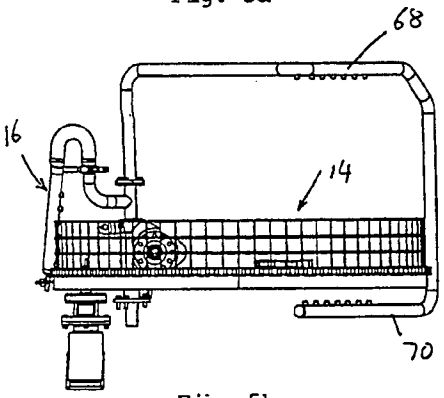

Simultaneous with the motion of the upper and lower horizontal manifolds 68 and 70 the distributor 16 moves with the following motion. When the manifolds 68 and 70 are at their radial outermost position shown in FIGS. 5*a* and 5*b*, the distributor 16/tube 54 is tilted to its maximum inclination with its upper end 58 forward of its lower end 56 relative to the platform axis. In this configuration the outlets 26 direct solid jets of liquid in a generally radial inward and downwardly inclined direction. This position of the distributor 16 is a result of the flexible hose twisting under a torsion load as the elbow 60 rotates about the longitudinal axis of the pipe 66. Additionally, as the distributor 16 is inclined to the vertical the pin 86 is displaced vertically upward or lifted from the slot 88 in comparison to its position when the distributor 16 is disposed absolutely vertically. Thus, in addition to the tilting motion of the distributor 16 there is also a displacement in the vertical plane up and down of the distributor 16. Further, the torsion in the flexible hose 59 is also transmitted to the distributor 16 causing a degree of rotation about its length.

Figure 6A:
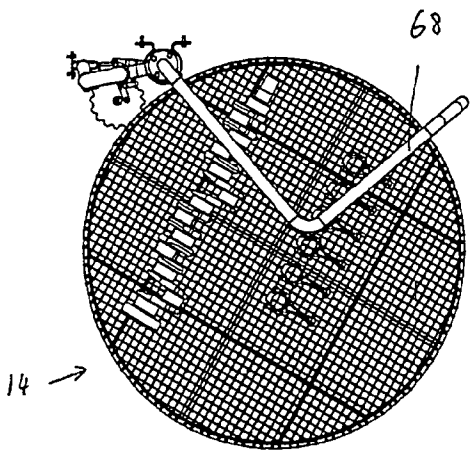
FIGS. 6*a* and 6*b* depict plan and side views respectively of the manifold system including the distributor in a second position.
Figure 6B:
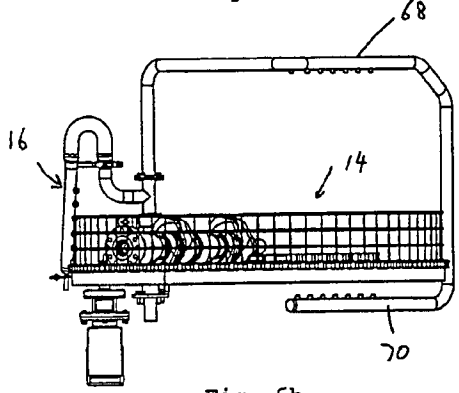

As the gear wheel 50 is rotated to move the horizontal manifolds 68, 70 radially inward of the platform 14, the distributor 16 is moved to a position where its degree of tilt is between the maximum tilt and the vertical as shown in FIGS. 6*a* and 6*b*. The movement of the distributor from its forward-most tilting position to this intermediate tilt position is accompanied by a further rotation in a clockwise direction about its length. When in this configuration, the outlets 26 direct a jet of liquid radially inward and downward but with a reduced inclination.

Figure 7A:
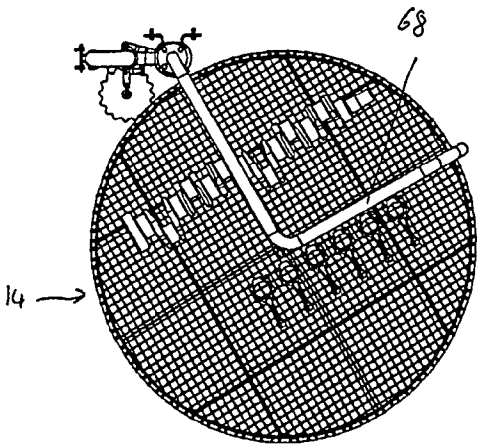
FIGS. 7*a* and 7*b* depict plan and side views respectively of the manifold system and distributor in a third position.
Figure 7B:
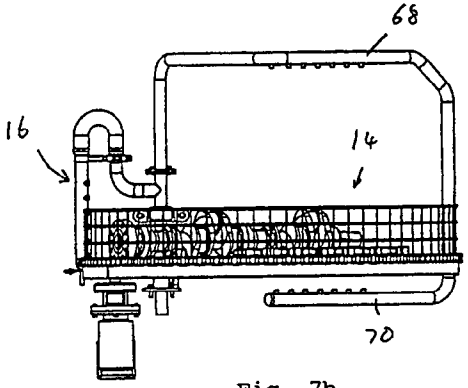

Continued rotation of the gear wheel 50 moves the horizontal manifolds 68, 70 to their radial innermost position over the platform 14, and tilts the distributor 16 rearwardly so that it is now substantially vertical as shown in FIGS. 7*a* and 7*b*, although it may indeed be tilted behind the vertical so that its upper end 58 is behind bottom end 56. The pin 86 is pushed to its deepest position with slot 88 and there is no vertical displacement of the distributor 16. Also, the rearward tilting of the distributor 16 is accompanied by a rotation of the distributor 16 about its longitudinal axis in a clock-wise direction.

As the gear wheel 50 continues to rotate, the abovementioned motion of the distributor 16 and upper and lower manifolds 68, 70 is reversed, and cyclically repeats. The cyclical motion of the manifold system 64 which results in a backward and forward tilting of the distributor 16 together with rotation in clock-wise and anti clock-wise directions about its longitudinal axis provides a jet of liquid that fans in both the horizontal and vertical planes.

A cleaning zone is created in the cabinet, being the zone or 3 dimensional volume that is cyclically swept by the liquid jets of the distributor 16 and manifolds 68 and 70, and through which the articles to be cleaned are cyclically passed by the rotating platform 14.

The motion of the distributor 16 and the manifolds 68 and 70 provide a cyclic sweeping of their corresponding liquid jets across the cleaning zone from: one side, above, and below, respectively of the cleaning zone.

The gearing between gears 34 and 50 and the reciprocating motion of the manifold system 52 is arranged to be out of phase so that one complete revolution of the platform 14 occurs before or after one complete cycle of reciprocation of the manifold system. This results in the jets of liquid striking different points on the articles on the platform for a number of successive revolutions. This enhances the three-dimensional sweeping pattern to increase the likelihood of all internal and external surfaces of the articles being impacted by liquid jets. The mechanical/kinetic energy of the liquid jets assists in blasting contaminants and grease from the articles. This in turn can allow the use of lower temperature water and less detergent and also the use of non-emulsifying and quick break detergents.

Figure 4D:
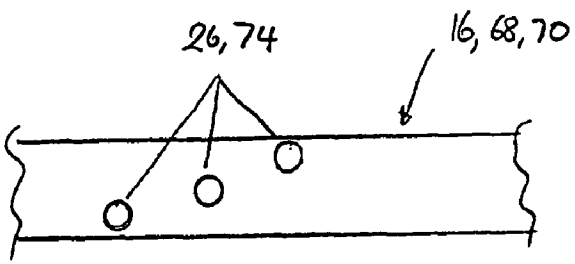
FIG. 4*d* is a schematic representation of an alternate outlet configuration.
Figure 4C:
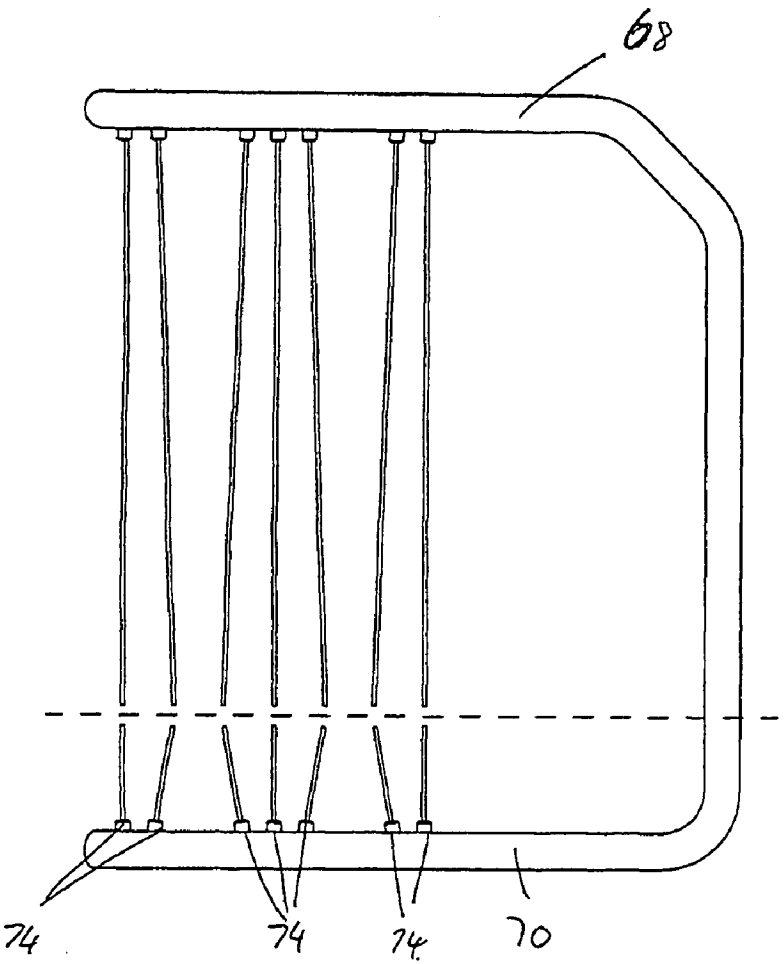
FIG. 4*c* is a schematic representation of an outlet configuration of the manifold system.

In FIGS. 4*a* and 4*b* the outlets 26 of distributor 16, and outlets 74 of manifolds 68 and 70 are shown as being arranged in straight lines so that their corresponding liquid jets eminate in a plane containing and perpendicular to the corresponding distributor manifold. However in an alternate embodiment the outlets 26, 74 can be arranged to produce divergent liquid jets. This is illustrated in part with reference to the outlets 74 in FIG. 4*c*. Here, the outlets 74 are arranged in two outer groups of two outlets and a central group of three outlets on each of the manifolds 68 and 70. The outermost outlets 74 in each of the two outer groups direct liquid jets in a substantially vertical plane (i.e., straight up or straight down). The inner outlets 74 in each of the outer groups direct liquid in an inclined path but still in the plane containing the respective manifold. The central outlet in the central group of three outlets directs liquid in a substantially vertical plane, while the outer outlets in each of the central groups direct liquid in inclined paths away from the jet emanating from the central outlet. This configuration of the outlets 74 combined with the rotation of the platform and motion of the manifolds 68 and 70 may further assist in providing a three dimensional sweep pattern of liquid jets enabling the cleaning of the inside surface of cupped or generally concavely shaped articles. In yet a further variation the outlets 26, 74 may be offset from each other about the axis of their corresponding manifold rather than all being in alignment, as shown in FIG. 4*d*. Thus in this embodiment the liquid jets diverge from the plane containing their corresponding manifold.

Referring to FIGS. 1, 8*a*, 8*b* and 9 the cabinet 12 comprises: a receptacle 96 in which the platform 14 and distributor 16 are disposed; and, a lid 98 attached to the receptacle 96.

Figure 8B:
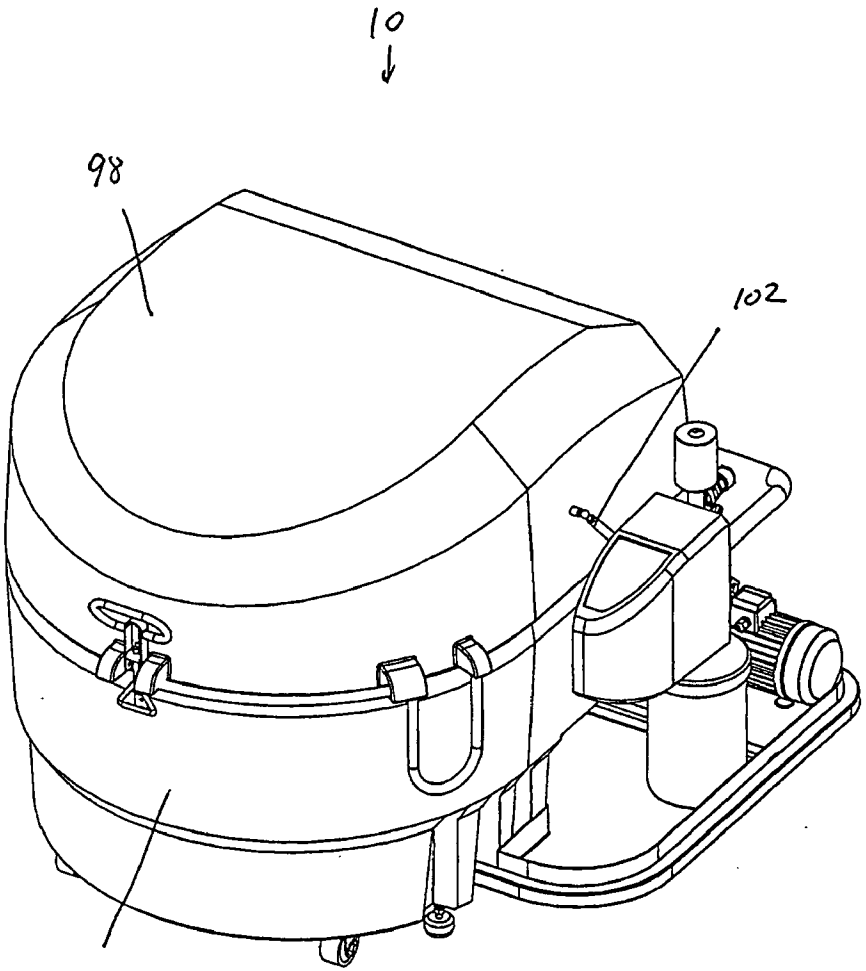
FIGS. 8*a* and 8*b* depict views from alternate angles of the parts washer when closed.
Figure 8A:
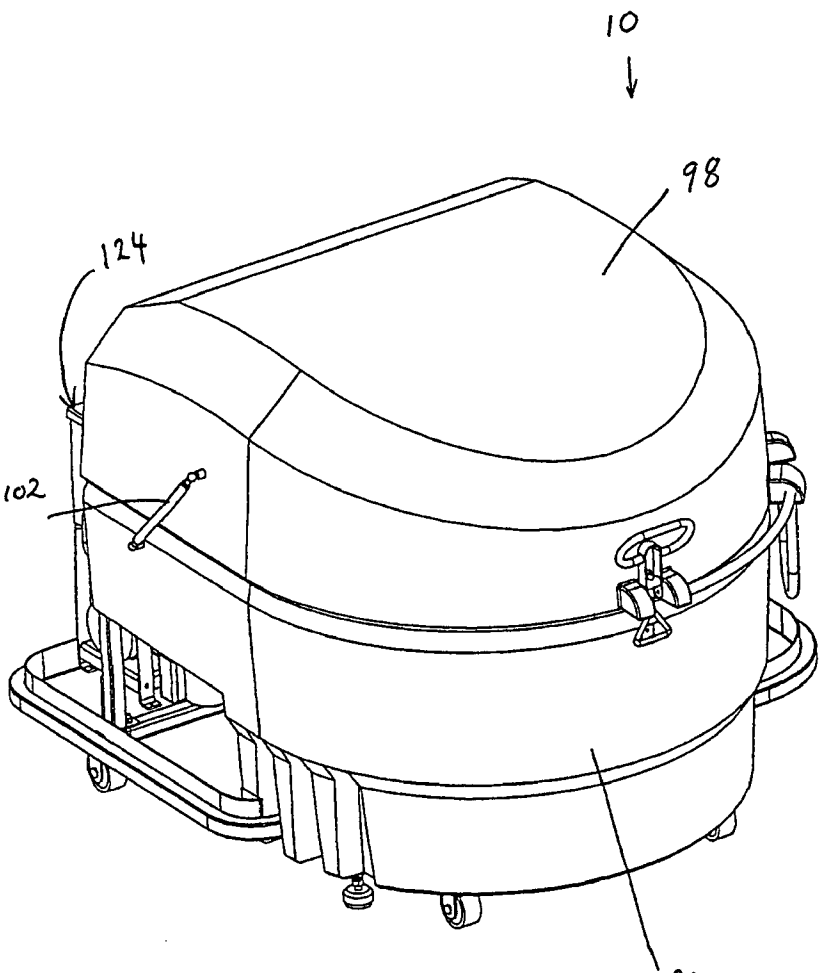
Figure 9:
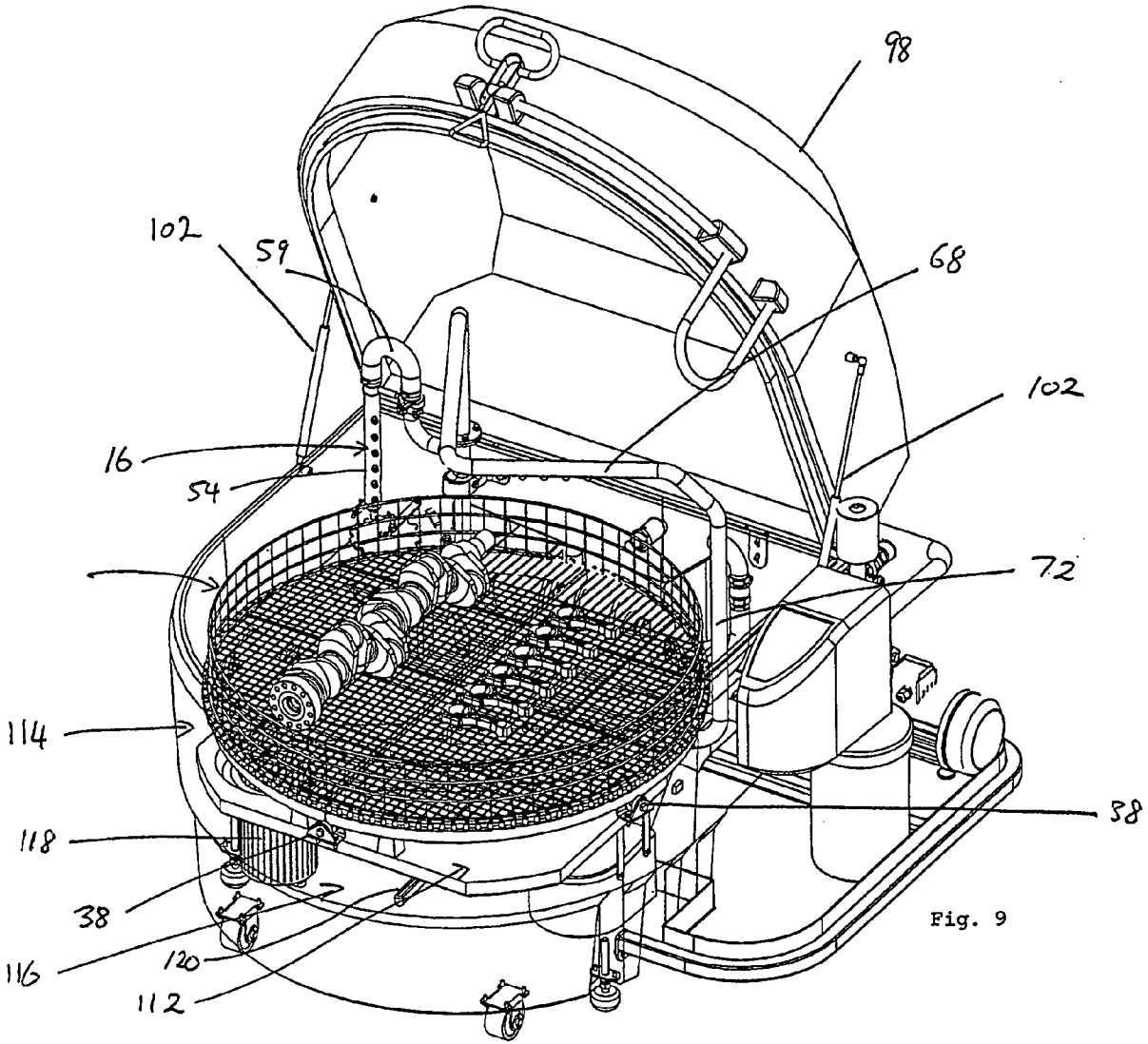
FIG. 9 is a schematic representation of the parts washer in an open state in partial cutaway view.

The lid 98 is hinged to the receptacle 96 and moveable between a closed position shown in FIGS. 8*a* and 8*b* where the lid closes the receptacle 96, and an open position shown in FIGS. 1 and 9 where the cabinet 12 is opened to allow access to the platform 14. In one embodiment the lid 98 is made from a plastics material such a double wall, foam filled, high density polyethylene or a composite material such as fiberglass or carbon fiber composites. Hitherto, lids of parts washing machines have been made from metal. Making the lid 98 from a plastics or composite material substantially reduces its weight. This has several benefits including allowing the use of much lighter and less powerful gas struts 102 for coupling the receptacle 96 and lid 98 and which assist in the opening and closing of the lid 98. This is of economic significance as the gas struts 102 for the parts washer 10 would be significantly less expensive than the struts used to support movement of a metal lid 98.

The receptacle 96 can likewise be made of a single piece unit from double wall foam filled high density polyethylene. As shown in FIG. 9 the receptacle 96 is provided with a moveable cover plate 112, advantageously made of a heat insulated plastics material or composite material sheet, that divides the receptacle 96 into an upper chamber 114 where the platform 14 resides and a lower liquid storage tank 116. Also disposed within the storage tank 116 is a strainer basket 118, heater 120 and oil skimmer (not shown).

When the parts washer 10 is in use, water is delivered to the tank 116. A small quantity of detergent is added to the water. The heater 120 acts to heat the water to a temperature in the order of 60° C.-70° C. The water is pumped through the manifold system 52 which in turn delivers or directs the water with detergent onto the component parts 22 and 24. This liquid is returned to the tank 16 via the strainer basket 118. The oil skimmer skims oil from the surface of the water returned to the tank 116 which in turn is delivered to an oil separator 124 (see FIG. 8*a*) mounted to the rear of the receptacle 96. The separator 124 separates the oil from the water, returning the water to the tank 116 and holding the oil 124 in a sump for later collection.

In the above described embodiment the outlets 26 are in the form of nozzles that are screwed into or otherwise attached to the manifolds 54, 68 and 70 and arranged to provide a solid jet of liquid. However the outlets 26 need not necessarily produce a solid jet. A broader spray can be used. This can be achieved by appropriately configuring the nozzles, or simply drilling holes in the manifolds 54, 68 and 70 to form the outlets. For example, it is believed that drilled holes with a conventional drill bit will provide a spray with a divergence of between 5°-10°.

Modifications and variations of the above described embodiment that would be obvious to a person of ordinary skill in the art are deemed to be within the scope of the present invention the nature of which is to be determined from the above description and the appended claims.

The invention claimed is:

1. A parts washer comprising:

a cabinet;

a rotatable platform disposed in the cabinet on which articles to be cleaned are supported;

a liquid distributor located inside the cabinet and to a side of the platform, the liquid distributor having a longitudinal axis that extends in a generally upright disposition and one or more outlets that direct liquid in a generally radial inward direction with respect to an axis of rotation of the platform;

a coupling that couples the distributor to the cabinet in the manner allowing at least two degrees of freedom of motion of the distributor; and, a drive system that drives both the rotatable platform and the distributor to move with the at least two degrees of freedom, wherein one of the at least two degrees of freedom is a reciprocating tilting motion of the distributor wherein the longitudinal axis of the distributor moves generally radially toward and away from the platform.

2. The parts washer according to claim 1 wherein the coupling allows the distributor to additionally move with any one or both of the following motions:

(a) a reciprocating rotational motion about the longitudinal axis of the distributor; and, (b) a reciprocating up and down motion.

3. The parts washer according to claim 1 wherein the coupling comprises a pin coupled to an end of the distributor, and a slot in which the pin resides.

4. The parts washer according to claim 3 wherein the pin is coupled to and extends from a lower end of the distributor.

5. The parts washer according to claim 1 wherein the distributor comprises part of a manifold system that directs liquid toward the platform, the manifold system comprising a pipe in fluid communication with the distributor and wherein the pipe is coupled by a swivel joint to an end of the distributor opposite the coupling.

6. The parts washer according to claim 5 wherein the manifold system comprises at least one reciprocating horizontally extending manifold in fluid communication with the pipe and the distributor.

7. The parts washer according to claim 5 wherein the drive system is coupled to the pipe to effect reciprocating motion of the pipe back and forth about a longitudinal axis of the pipe.

8. The parts washer according to claim 1 comprising a support system that supports the platform about its radial outer periphery.

9. The parts washer according to claim 8 wherein the support system further comprises one or more rollers or bearings that support the radial outer periphery of the platform.

10. The parts washer according to claim 8 wherein the drive system engages the radial outer periphery of the platform to impart torque to the platform.

11. The parts washer according to claim 1 wherein the drive system engages a radial outer periphery of the platform to impart torque to the platform.

12. The parts washer according to claim 1 wherein the cabinet comprises a receptacle in which the platform is disposed and a hinged lid, where the receptacle is made from a plastics or composite material.

13. The parts washer according to claim 1 wherein the distributor is a part of a manifold system that directs liquid toward the platform, the manifold system comprising a pipe coupled to the drive system and a flexible hose providing fluid communication between the pipe and the distributor.

* * * * *